US011293225B2

(12) United States Patent
Heredia et al.

(10) Patent No.: US 11,293,225 B2
(45) Date of Patent: Apr. 5, 2022

(54) ELECTROMECHANICAL ACTUATOR AND HOME AUTOMATION INSTALLATION COMPRISING SUCH AN ACTUATOR

(71) Applicant: SOMFY ACTIVITES SA, Cluses (FR)

(72) Inventors: Stéphane Heredia, Divonne les Bains (FR); Rémi Sourain, Domancy (FR); Gilles Pradel, Lyons (FR)

(73) Assignee: SOMFY ACTIVITES SA, Cluses (FR)

( * ) Notice: Subject to any disclaimer, the term of this patent is extended or adjusted under 35 U.S.C. 154(b) by 0 days.

(21) Appl. No.: 17/288,456

(22) PCT Filed: Oct. 25, 2019

(86) PCT No.: PCT/EP2019/079130
§ 371 (c)(1),
(2) Date: Apr. 23, 2021

(87) PCT Pub. No.: WO2020/084103
PCT Pub. Date: Apr. 30, 2020

(65) Prior Publication Data

US 2021/0310305 A1 Oct. 7, 2021

(30) Foreign Application Priority Data

Oct. 26, 2018 (FR) ..... 1859917

(51) Int. Cl.
*E06B 9/90* (2006.01)
*E06B 9/72* (2006.01)

(52) U.S. Cl.
CPC ..... *E06B 9/90* (2013.01); *E06B 9/72* (2013.01); *E06B 2009/905* (2013.01)

(58) Field of Classification Search
CPC ..... E06B 9/90; E06B 2009/905; E06B 9/72; E06B 9/68; E06B 9/80; E06B 9/40;
(Continued)

(56) References Cited

U.S. PATENT DOCUMENTS 4,498,517 A 2/1985 Mase
4,848,433 A * 7/1989 Bresson ..... E06B 9/322 160/178.1 R (Continued)

FOREIGN PATENT DOCUMENTS

CN 101839111 A 9/2010
CN 101929303 A 12/2010

(Continued)

OTHER PUBLICATIONS

International Search Report for PCT/EP2019/079130 dated Nov. 27, 2019, 5 pages.

(Continued)

*Primary Examiner* — Johnnie A. Shablack
*Assistant Examiner* — Jeremy C Ramsey
(74) *Attorney, Agent, or Firm* — Nixon & Vanderhye

(57) ABSTRACT

Disclosed is an electromechanical actuator including a spring brake including a helical spring, a drum, an input member and an output member. The drum includes a friction surface configured to cooperate with at least one turn of the spring. The output member includes at least one lug. The lug includes a recess provided with at least a first bearing surface configured to cooperate with one of the first and second legs of the spring. The first bearing surface of the recess is inclined with respect to an axis of rotation of the brake at an angle of inclination of non-zero value.

20 Claims, 6 Drawing Sheets

(58) Field of Classification Search
CPC ..... E06B 9/42; E06B 9/56; E06B 2009/807; H02K 2207/03; F16D 59/00; F16D 59/02; F16D 1/0823; F16D 13/025; F16D 13/08; F16D 128/025; F16D 27/105
See application file for complete search history.

(56) References Cited

U.S. PATENT DOCUMENTS

| | | | | |
|---|---|---|---|---|
| 8,253,288 | B2 * | 8/2012 | Lagarde | F16D 51/02 310/77 |
| 8,469,171 | B2 * | 6/2013 | Lagarde | F16D 67/00 192/223.4 |
| 11,053,735 | B2 * | 7/2021 | Sonzini | E06B 9/90 |
| 2020/0378182 | A1 * | 12/2020 | Heredia | B24B 33/02 |

FOREIGN PATENT DOCUMENTS

| | | | |
|---|---|---|---|
| CN | 103746510 | A | 4/2014 |
| CN | 104662249 | A | 5/2015 |
| CN | 204419000 | U | 6/2015 |
| CN | 105178836 | A | 12/2015 |
| EP | 2 230 415 | A1 | 9/2010 |
| EP | 2 267 330 | A1 | 12/2010 |
| FR | 2 610 668 | A1 | 8/1988 |
| FR | 2 995 001 | | 3/2014 |
| GB | 189412 | A | 7/1923 |

OTHER PUBLICATIONS

Written Opinion of the ISA for PCT/EP2019/079130 dated Nov. 27, 2019, 5 pages.
French Search Report for FR 1859917 dated Jul. 16, 2019, 2 pages.

* cited by examiner

ELECTROMECHANICAL ACTUATOR AND HOME AUTOMATION INSTALLATION COMPRISING SUCH AN ACTUATOR

CROSS-REFERENCE TO RELATED APPLICATIONS

This application is the U.S. national phase of International Application No. PCT/EP2019/079130 filed Oct. 25, 2019 which designated the U.S. and claims priority to FR 1859917 filed Oct. 26, 2018, the entire contents of each of which are hereby incorporated by reference.

BACKGROUND OF THE INVENTION

Field of the Invention

The present invention relates to an electromechanical actuator. The electromechanical actuator comprises a spring brake. This type of brake is more particularly adapted for a so-called tubular electromechanical actuator.

The present invention also relates to a home automation installation for closure or sun-protection comprising a screen able to be wound on a winding tube rotated by a such electromechanical actuator.

In general, the present invention relates to the field of concealing devices comprising a motorized driving device setting a screen in motion, between at least a first position and at least a second position.

Description of the Related Art

A motorized drive device comprises an electromechanical actuator for a movable element for closing, concealing or sun-protection such as a shutter, a door, a gate, a blind or any other equivalent material, hereinafter referred to as a screen.

We know already the document FR 2 995 001 A1 which describes an electromechanical actuator for a home automation installation for closure or sun-protection. The electromechanical actuator comprises an electric motor, a reducer, and a spring brake. The spring brake comprises a helical spring, a drum, an input member and an output member. The helical spring is formed from a wire. A first end of the helical spring forms a first tab, extending radially relative to an axis of rotation of the spring brake. A second end of the helical spring forms a second tab, extending radially relative to the axis of rotation of the spring brake. The turns of the helical spring are configured to be joined contiguous in a state of rest of the spring brake. The drum comprises a housing, cylindrical in shape. The housing of the drum comprises an inner friction surface configured to cooperate with at least one turn of the helical spring, in an assembled configuration of the spring brake. In this way, at least one turn of the helical spring is radially constrained by the housing of the drum. The output member comprises a first lug and a second lug. Each of the first and second lugs has a recess. The recess in each of the first and second lugs comprises a bearing surface configured to cooperate with one of the first and second tabs of the helical spring, in the assembled configuration of the spring brake.

The input member is configured to be rotated by the electric motor. A driving tooth of the input member is configured to cooperate with one of the first and second tabs of the helical spring, so as to rotate the helical spring around an axis of rotation of the spring brake in a first direction of rotation. Such a movement releases the spring brake. The frictional force between the turns of the helical spring and the inner surface of the housing of the drum is reduced when the helical spring is rotated in the first direction of rotation. In other words, this movement tends to decrease the diameter of the outer enclosure of the helical spring and therefore to decrease the radial stress between the helical spring and the inner surface of the housing of the drum.

One of the first and second lugs of the output member is configured to cooperate with one of the first and second tabs of the helical spring, so as to rotate the helical spring around the axis of rotation of the spring brake in a second direction of rotation, the second direction of rotation being opposite to the first direction of rotation. Such a movement activates the spring brake. The frictional force between the turns of the helical spring and the inner surface of the housing of the drum is increased when the helical spring is rotated in the second direction of rotation. In other words, this movement tends to increase the diameter of the outer enclosure of the helical spring and thus increase the radial stress between the helical spring and the inner surface of the housing of the drum.

However, this electromechanical actuator has the drawback of generating operating noise and spacing the turns of the helical spring from each other, during a braking phase implemented by the spring brake. This is due to the fact that the bearing surface of the recess in the output member is parallel to the axis of rotation of the spring brake. The braking phase implemented by the spring brake corresponds, more particularly, to a lowering phase of a screen of a screening device of the installation.

Therefore, the spacing of the turns of the helical spring from each other, during the braking phase of the spring brake, causes the turns of the helical spring to separate from each other, in the state of rest of the spring brake.

SUMMARY OF THE INVENTION

The present invention aims to resolve the above-mentioned drawbacks and to propose an electromechanical actuator for a home automation installation for closure or sun-protection comprising a spring brake, as well as a home automation installation for closure or sun-protection comprising such an electromechanical actuator, to prevent the turns, i.e., coils, of the helical spring from moving apart from each other, during a braking phase implemented by the spring brake, and to reduce the operating noise of the spring brake, when rotating an input and/or output member relative to a drum.

To that end, according to a first aspect, the present invention relates to an electromechanical actuator for a home automation installation for closure or sun-protection, the electromechanical actuator comprising at least:
- an electric motor,
- a reducer, and
- a spring brake, the spring brake comprising at least:
- a helical spring,
  - the helical spring being formed from a wire,
  - a first end of the helical spring forming a first tab,
  - a second end of the helical spring forming a second tab,
  - the helical spring being of contiguous turns, in a resting state of the spring brake,
- a drum,
  - the drum comprising a friction surface configured to cooperate with at least a turn of the helical spring, in an assembled configuration of the spring brake,
- an input member, and
- an output member, the output member comprising at least a lug, the lug comprising a recess, the recess of the lug comprising at least a first bearing surface configured to cooperate with one of the first and second tabs of the helical spring, in the assembled configuration of the spring brake.

According to the invention, the first bearing surface of the recess of the lug is inclined with respect to an axis of rotation of the spring brake by an angle of inclination of non-zero value.

Thus, the angle of inclination of the first bearing surface of the recess of the output member with respect to the axis of rotation of the spring brake prevents the turns of the helical spring from moving apart from each other, during a braking phase of the spring brake, and, more particularly, of a first turn of the helical spring in relation to a subsequent turn of the helical spring, during a braking phase of the spring brake, as well as to reduce the operating noise of the spring brake, during the rotational drive of the input member and/or the output member in relation to the drum.

In this way, the angle of inclination of the first bearing surface of the recess of the output member in relation to the axis of rotation of the spring brake guarantees a lateral force on one of the first and second tabs of the helical spring, so that the turns of the helical spring are held contiguous, during a braking phase of the spring brake.

Moreover, a separation of the turns of the helical spring from each other and, more particularly, of the first turn of the helical spring from the next turn of the helical spring, is thus avoided in a state of rest of the spring brake, since the turns of the helical spring remain in a same position relative to the drum, following a braking phase of the spring brake.

Furthermore, the angle of inclination of the first bearing surface of the recess of the output member in relation to the axis of rotation of the spring brake makes it possible to induce a force at the level of one of the first and second tabs of the helical spring and thus to attenuate the vibration of the helical spring, by stabilizing this force at the level of the first turn of the helical spring.

The first turn of the helical spring can also be called the end turn of the helical spring connected to one of the first and second tabs of the helical spring.

According to an advantageous feature of the invention, the value of the angle of inclination is comprised in a range of values between 5° and 45° and is, preferably, in the range of 20° to 25°.

According to another advantageous feature of the invention, the inclination of the first bearing surface of the recess with respect to the axis of rotation of the spring brake is such that this first bearing surface is oriented towards the interior of the output member.

According to another advantageous feature of the invention, the output member comprises a first lug and a second lug. Each of the first and second lugs comprises a recess. The recess in each of the first and second lugs comprises at least the first bearing surface configured to cooperate with one of the first and second tabs of the helical spring, in the assembled configuration of the spring brake. Moreover, the first bearing surface of at least one of the recesses in the output member is inclined with respect to the axis of rotation of the spring brake by a non-zero angle of inclination.

According to another advantageous feature of the invention, in the assembled configuration of the spring brake, the recess of the output member comprising the first bearing surface inclined with respect to the axis of rotation of the spring brake is that of the first or second lug of the output member configured to cooperate with the first or second tab of the helical spring, during a braking phase of the spring brake.

According to another advantageous feature of the invention, the first bearing surface of each of the recesses of the output member is inclined relative to the axis of rotation of the spring brake by the non-zero angle of inclination.

According to another advantageous feature of the invention, each of the first and second tabs of the helical spring extends radially with respect to the axis of rotation of the spring brake.

According to another advantageous feature of the invention, the input member comprises a driving tooth. Moreover, in the assembled configuration of the spring brake, the first tab of the helical spring is configured to cooperate with a first surface of the driving tooth of the input member and the second tab of the helical spring is configured to cooperate with a second surface of the driving tooth of the input member. The second surface of the driving tooth is opposite to the first surface of the driving tooth.

According to another advantageous feature of the invention, the spring brake also comprises a cap.

According to another advantageous feature of the invention, the input member and the cap are held together fixed, in the assembled configuration of the spring brake, so as to rotate about the axis of rotation.

According to another advantageous feature of the invention, the recess comprises at least a second bearing surface inclined with respect to the axis of rotation of the spring brake by an angle of inclination of non-zero value.

According to a second aspect, the present invention relates to a home automation installation for closure or sun-protection comprising a screen that can be rolled up on a winding tube driven in rotation by an electromechanical actuator according to the invention.

This home automation installation presents features and advantages similar to those previously described relative to the electromechanical actuator according to the invention, as described above.

BRIEF DESCRIPTION OF THE DRAWINGS

Other features and advantages of the invention will appear in the description below. In the appended drawings, provided as non-limiting examples.

DESCRIPTION OF THE PREFERRED EMBODIMENTS

First of all, with reference to FIGS. 1 to 8, we describe a home automation installation according to a first embodiment of the invention and installed in a building comprising an opening 1, window or door, equipped with a screen 2 belonging to a concealing device 3, in particular a motorized roller shutter.

Figure 1:
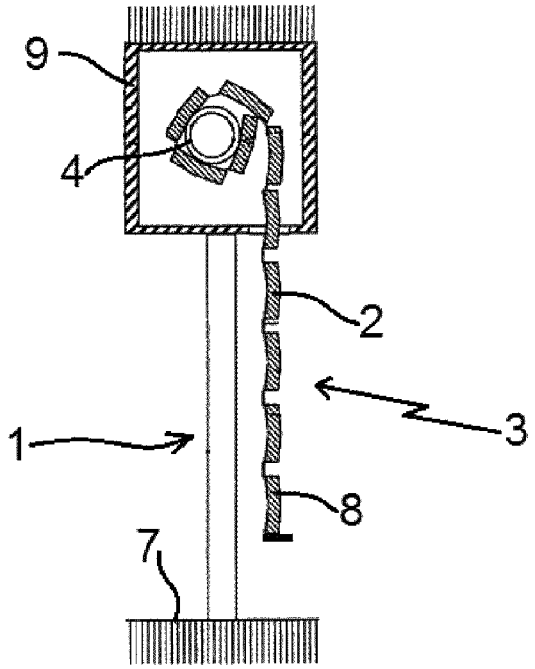
FIG. 1 is a cross-sectional schematic view of a home automation installation according to a first embodiment of the invention.
Figure 2:
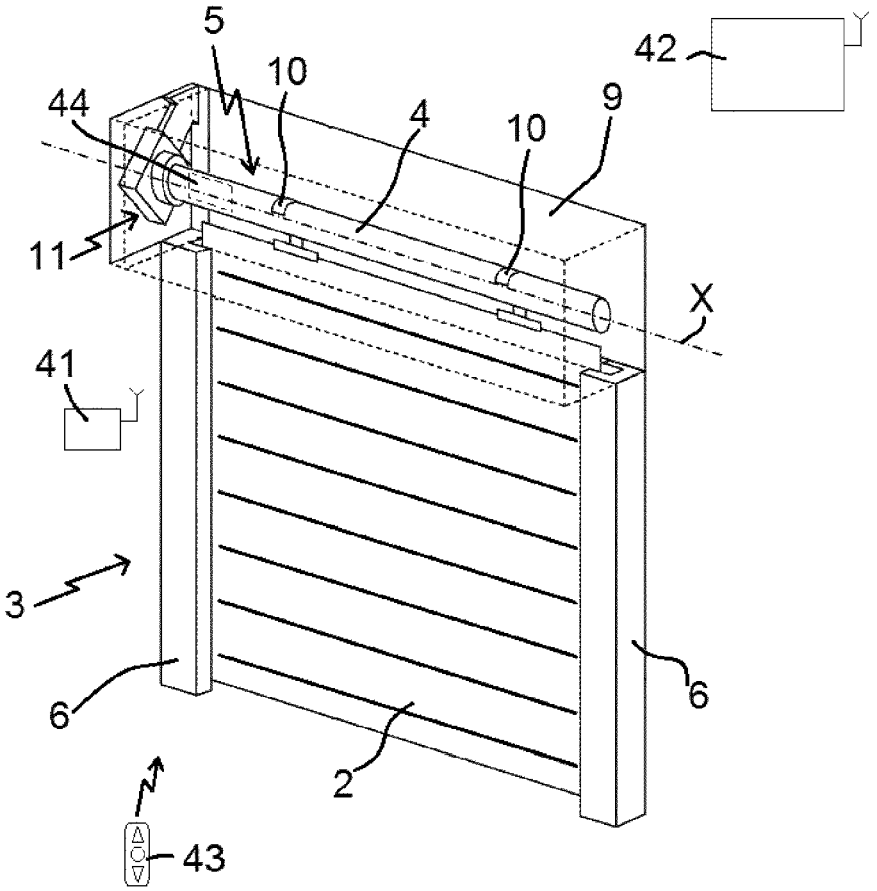
FIG. 2 is a schematic perspective view of the home automation installation illustrated in FIG. 1.

The concealing device 3 can be a roller shutter, as illustrated in FIGS. 1 and 2, a blind with a fabric or a blind with adjustable slats, or a roller gate. The present invention applies to all types of concealing devices.

A roller shutter is described, with reference to FIGS. 1 and 2, in accordance with an embodiment of the invention.

The screen 2 of the concealing device 3 is wound on a winding tube 4 driven by a motorized driving device 5 and movable between a wound position, in particular an upper position, and an unwound position, in particular a lower position.

The moving screen 2 of the concealing device 3 is a closing, concealing and/or sun-protection screen, winding on the winding tube 4, the inner diameter of which is substantially greater than the outer diameter of an electromechanical actuator 11, such that the electromechanical actuator 11 can be inserted into the winding tube 4, when the concealing device 3 is assembled.

The motorized driving device 5 comprises the electromechanical actuator 11, in particular of the tubular type, which is used to rotate the winding tube 4, so that the screen 2 of the concealing device 3 can be unwound or wound up.

The concealing device 3 comprises the winding tube 4 for winding up the screen 2. In the assembled state, the electromechanical actuator 11 is inserted into the winding tube 4.

In a known manner, the roller shutter, which forms the concealing device 3, comprises an apron comprising horizontal slats articulated on one another, forming the screen 2 of the concealing device 3, and guided by two lateral guideways 6. These slats are joined together, when the apron of the screen 2 of the concealing device 3 reaches its lower unrolled position.

In the case of a roller shutter, the upper rolled up position corresponds to the bearing of a final end slat 8, which is for example L-shaped, of the apron 2 of the roller shutter 3 against an edge of a box 9 of the roller shutter 3 or when the final end slat 8 stops in a programmed upper end-of-travel position. Moreover, the lower unrolled position corresponds to the bearing of the final end slat 8 of the apron 2 of the roller shutter 3 against a threshold 7 of the opening 1 or the stopping of the final end slat 8 in a programmed lower end-of-travel position.

The first slat of the apron 2 of the roller shutter 3, which is opposite to the final end slat 8, is connected to the winding tube 4 using at least an articulation 10, in particular a strip-shaped connection piece.

The winding tube 4 is positioned inside the box 9 of the roller shutter 3. The apron 2 of the roller shutter 3 winds and unwinds around the winding tube 4 and is housed at least partially inside the box 9.

In general manner, the box 9 is positioned above the opening 1, or in the upper part of the opening 1.

The motorized driving device 5 is controlled by a command unit. The command unit can be for example a local command unit 41, where the local command unit 41 can be wired or wirelessly connected to a central command unit 42. The central command unit 42 can control the local command unit 41, as well as other similar local command units distributed throughout the building.

The central command unit 42 can be in communication with a remote weather station outside the building, including, in particular, one or more sensors that can be configured, for example, to determine a temperature, a brightness, or a wind speed.

A remote control 43, which can be a type of local command unit, provided with a control keypad and which comprises selection and display elements further allows a user to intervene on the electromechanical actuator 11, the local command unit 41 and/or the central command unit 42.

The motorized driving device 5 is, preferably, configured to carry out the unwinding or winding commands of the screen 2 of the concealing device 3, which can be emitted, in particular, by the remote control 43.

Figure 3:
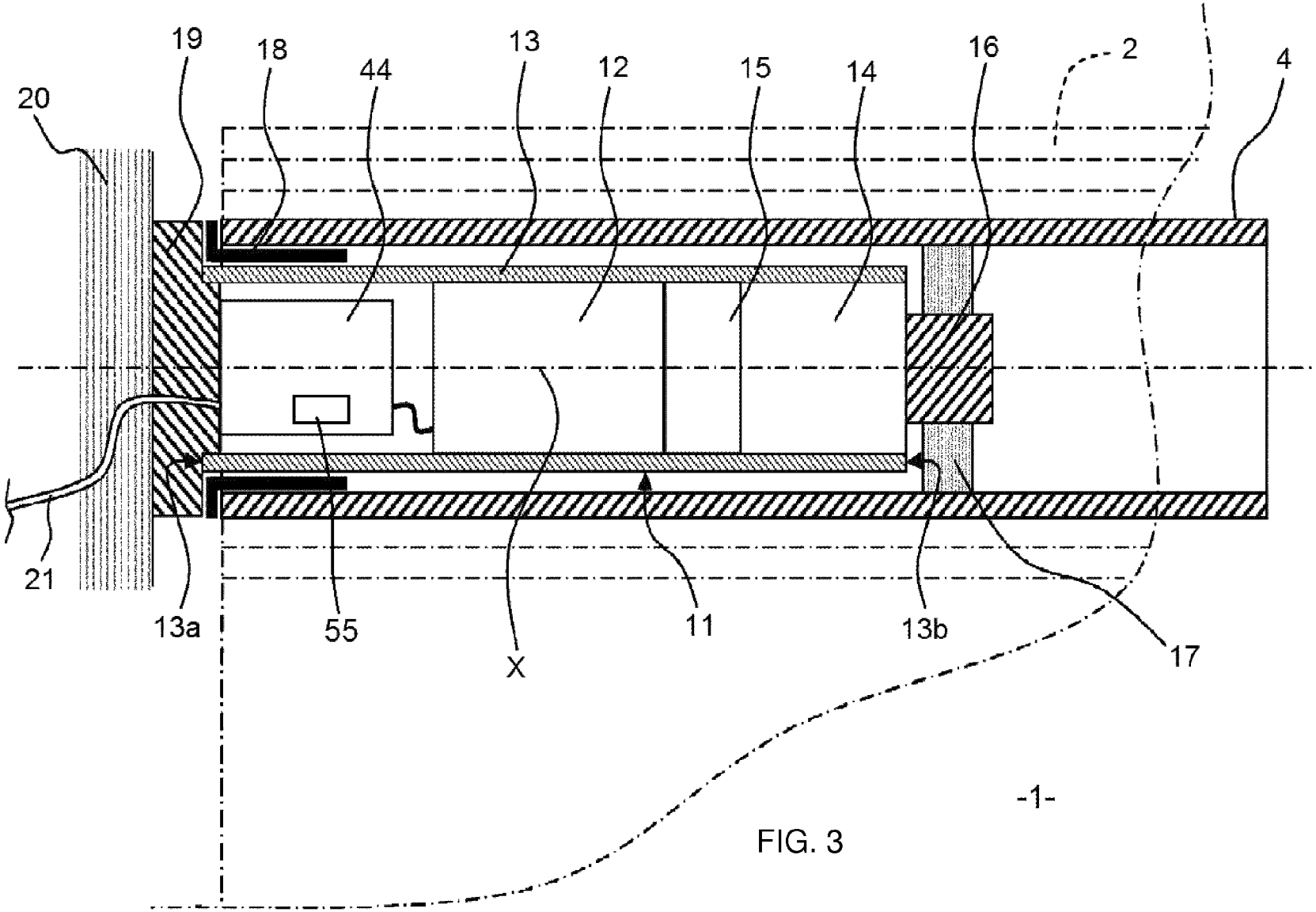
FIG. 3 is a schematic cross-sectional view partial and axial of the home automation installation illustrated in FIGS. 1 and 2, at the level of an electromechanical actuator.

The electromechanical actuator 11 belonging to the home automation installation of FIGS. 1 and 2 is now described in more details and in reference to FIG. 3.

The electromechanical actuator 11 comprises at least an electric motor 12, a reducer 14 and a spring brake 15.

The electric motor 12 comprises a rotor and a stator, not shown, positioned coaxially around a rotation axis X, which is also the rotation axis of the winding tube 4 in the assembled configuration of the motorized driving device 5.

Control means for controlling the electromechanical actuator 11, making it possible to move the screen 2 of the concealing device 3, comprise at least an electronic control unit 44. This electronic control unit 44 is able to operate the electric motor 12 of the electromechanical actuator 11 and, in particular, to allow the supply of electricity for the electric motor 12.

Thus, the electronic control unit 44 controls, in particular, the electric motor 12, so as to open or close the screen 2, as previously described.

Advantageously, the electronic control unit 44 also comprises a communication module 55, as shown in FIG. 3, in particular for receiving command orders, the command orders being emitted by an orders transmitter, such as the remote control 43, intended to command the electromechanical actuator 11, or one of the local or central command units 41, 42.

Preferably, the communication module 55 of the electronic control unit 44 is of the wireless type. In particular, the communication module 55 is configured to receive radio command orders.

The communication module 55 can also allow the reception of command orders transmitted by wired means.

Here, and as illustrated in FIG. 3, the electronic control unit 44 is positioned inside a casing 13 of the electromechanical actuator 11.

The control means of the electromechanical actuator 11 comprise hardware and/or software means.

As a non-limiting example, the hardware means may comprise at least a microcontroller.

The electromechanical actuator 11 is supplied with electricity by a mains electricity supply network, or using a battery, which can, for example, be recharged by a photovoltaic panel. The electromechanical actuator 11 makes it possible to move the screen 2 of the concealing device 3.

Here, the electromechanical actuator 11 comprises a power cable 21 allowing it to be supplied with electricity from a mains electricity supply network.

The casing 13 of the electromechanical actuator 11 is, preferably, cylindrical.

In an embodiment, the casing 13 is made from a metal material.

The material of the casing of the electromechanical actuator is in no way limiting and may be different. In particular, it can be a plastic material.

The winding tube 4 is rotated around the rotation axis X and the casing 13 of the electromechanical actuator 11 supported by two pivot links. The first pivot link is produced at a first end of the winding tube 4 using a ring 18 inserted around and at a first end 13*a* of the casing 13 of the electromechanical actuator 11. The ring 18 thus makes it possible to produce a bearing. The second pivot link, not shown in FIG. 3, is produced at a second end of the winding tube 4.

Advantageously, the electromechanical actuator 11 comprises a torque support 19. The torque support 19 protrudes at the first end 13*a* of the casing 13 of the electromechanical actuator 11, in particular the end 13*a* of the casing 13 receiving the ring 18. The torque support 19 of the electromechanical actuator 11 thus makes it possible to fasten the electromechanical actuator 11 onto a housing 20, in particular to a flange of the box 9.

Moreover, the torque support 19 of the electromechanical actuator 11 can make it possible to close off the first end 13*a* of the casing 13.

Furthermore, the torque support 19 of the electromechanical actuator 11 can make it possible to support the electronic control unit 44. The electronic control unit 44 can be supplied with electricity via the power cable 21 electrically connected to the mains electricity supply network, or to a battery.

Advantageously, the reducer 14 comprises at least a reduction stage. The reduction stage can be a gear train of the epicyclic type.

The type and number of reduction stages of the reducer are in no way limiting. For example, the number of reduction stages can be two or three.

The electromechanical actuator 11 comprises an output shaft 16. An end of the output shaft 16 protrudes relative to the casing 13 of the electromechanical actuator 11, in particular relative to a second end 13*b* of the casing 13 opposite to its first end 13*a*.

The output shaft 16 of the electromechanical actuator 11 drives in rotation, in other words is configured to rotate, a connecting element 17 connected to the winding tube 4, in an assembled configuration of the electromechanical actuator 11. The connecting element 17 is made in the form of a wheel.

When the electromechanical actuator 11 is operated, the electric motor 12 and the reducer 14 rotate the output shaft 16. Moreover, the output shaft 16 of the electromechanical actuator 11 rotates the winding tube 4 via the connecting element 17. Thus, the winding tube 4 rotates the screen 2 of the concealing device 3, so as to open or close the opening 1.

The electric motor 12, the reducer 14 and the spring brake 15 are mounted inside the casing 13 of the electromechanical actuator 11.

In the first embodiment illustrated in FIG. 3, the spring brake 15 is positioned between the electric motor 12 and the reducer 14, that is to say at the output of the electric motor 12.

In another embodiment, not shown, where the reducer 14 comprises a plurality of reduction stages, the spring brake 15 is positioned between two reduction stages of the reducer 14.

In another embodiment, not shown, the spring brake 15 is positioned at the output of the reducer 14.

The electromechanical actuator 11 may also comprise an end-of-travel and/or obstacle detection device, this. This detection device can be mechanical or electronic.

Figure 4:
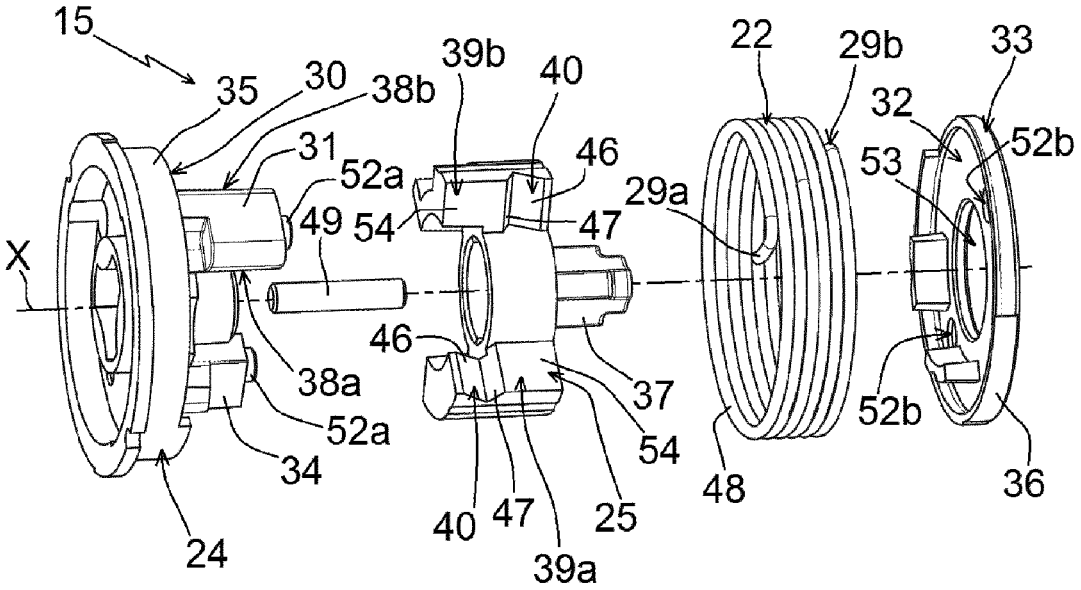
FIG. 4 is a schematic exploded and perspective view of a spring brake of the electromechanical actuator illustrated in FIG. 3, where a drum of the spring brake is omitted.

The spring brake 15 of the electromechanical actuator 11 is now described, with reference to FIGS. 4 to 8, as shown in FIG. 3 and according to the first embodiment of the invention. The left and right sides of the FIG. 4 are reversed in relation to the left and right sides of the FIGS. 5 and 6.

The spring brake 15 comprises at least a helical spring 22, a drum 23, an input member 24, an output member 25 and, possibly, a cap 33.

Advantageously, the drum 23 is kept in position in the casing 13 of the electromechanical actuator 11, in particular using clearances 28 arranged on the outer periphery of the drum 23 and cooperate, in other words configured to cooperate, with tongues, not shown, of an enclosure of the reducer 14, in the assembled configuration of the electromechanical actuator 11.

Moreover, the of the reducer 14 is kept in position in the casing 13 of the electromechanical actuator 11, by suitable mechanical elements, for example by means of form-fitting cooperation.

Advantageously, the drum 23 comprises a housing 26.

Here, the housing 26 of the drum 23 is cylindrical. Moreover, the housing 26 of the drum 23 is a through housing.

Advantageously, the helical spring 22, the input member 24, the output member 25 and, possibly, the cap 33 are positioned inside the housing 26 of the drum 23, in an assembled configuration of the spring brake 15.

Here, the output member 25 is positioned across from the input member 24.

The helical spring 22 comprises a plurality of turns. The turns of the helical spring 22 are centered on an axis combined with the rotation axis X, when the spring brake 15 is assembled, then mounted in the electromechanical actuator 11.

Likewise, the input member 24 and the output member 25 are centered on an axis combined with the axis of rotation X, when the spring brake 15 is assembled, then mounted in the electromechanical actuator 11.

The axis of each of the members 22, 23, 24, 25, 33 of the spring brake 15 is not shown in FIGS. 4 to 8, in order to simplify the reading thereof.

The drum 23 comprises a surface, called friction surface 27, cooperating, in other words configured to cooperate, with at least a turn of the helical spring 22, in the assembled configuration of the spring brake 15.

Advantageously, the friction surface 27 of the drum 23 is an internal surface of the housing 26 of the drum 23.

Thus, at least a turn of the helical spring 22 is radially stressed by the housing 26 of the drum 23.

Figure 5:
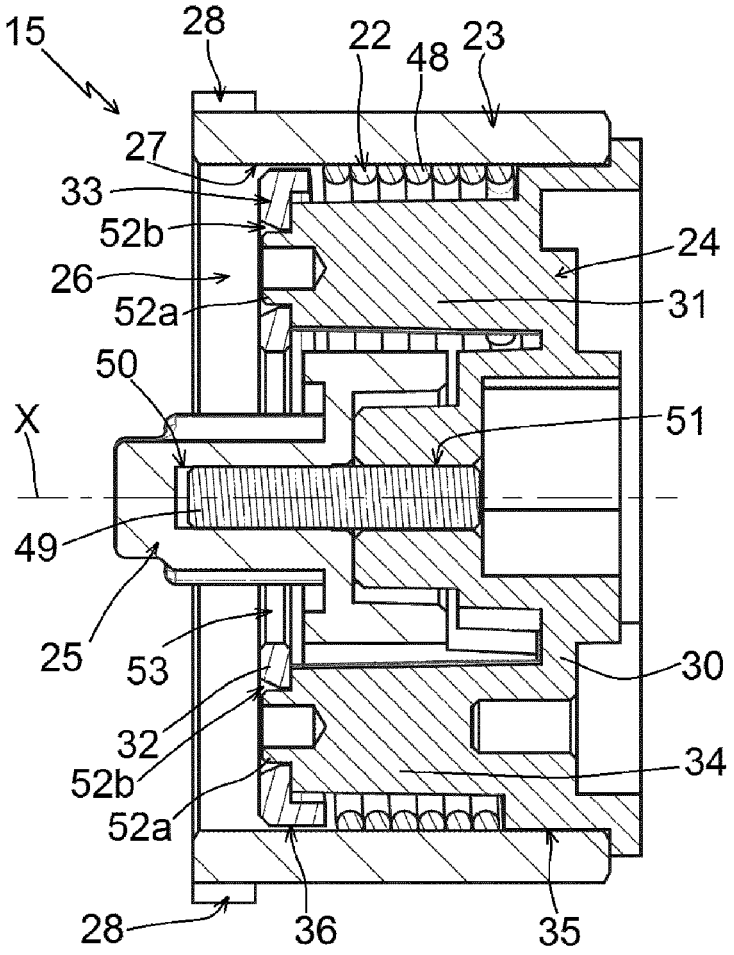
FIG. 5 is a schematic cross-sectional view of the spring brake illustrated in FIG. 4, according to a sectional plane passing through an axis of rotation of the spring brake, where the drum of the spring brake is shown.

Here, the helical spring 22 is mounted tightly inside the housing 26 of the drum 23, so as to secure the helical spring 22 and the drum 23 by friction, when the helical spring 22 is idle, as illustrated in FIG. 5.

The helical spring 22 is formed from a wire 48. A first end of the helical spring 22 forms a first tab 29*a*. A second end of the helical spring 22 forms a second tab 29*b*. The helical spring 22 is a helical spring with joined turns, in a state of rest of the spring brake 15.

Figure 6:
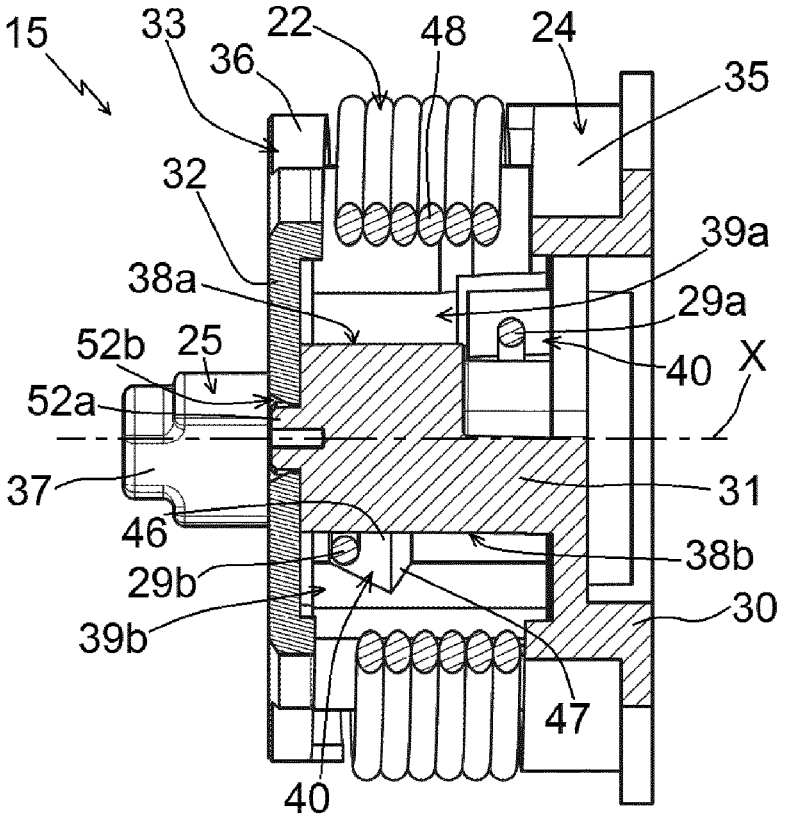
FIG. 6 is a schematic cross-sectional view of the spring brake illustrated in FIGS. 4 and 5, in a sectional plane offset from the axis of rotation of the spring brake, where the spring brake drum is omitted.

Thus, the helical spring 22 comprises two tabs 29*a*, 29*b*, respectively visible in FIGS. 4 and 6.

Advantageously, each of the first and second tabs 29*a*, 29*b* extends radially relative to the axis of rotation X and, in particular, towards the inside of the helical spring 22.

Here, each of the first and second tabs 29*a*, 29*b* of the helical spring 22 extends radially relative to the axis of rotation X, in the assembled configuration of the spring brake 15.

In a variant, not shown, each tab of the first and second tabs 29*a*, 29*b* of the helical spring 22 extends axially relative to the axis of rotation X, in the assembled configuration of the spring brake 15.

In this example of an embodiment, the first and second tabs 29*a*, 29*b* of the helical spring 22 extend radially relative to the axis of rotation X and toward the inside of the helical spring 22, in particular from the turns of the helical spring 22 toward the central axis of the helical spring 22, as illustrated in FIG. 4.

Advantageously, the input member 24 comprises a driving tooth 31.

Advantageously, the driving tooth 31 extends between the input member 24 and the cap 33, in the assembled configuration of the spring brake 15.

Advantageously, the driving tooth 31 of the input member 24 is inserted inside the helical spring 22, in the assembled configuration of the spring brake 15.

The input member 24, in particular the driving tooth 31 of the input member 24, cooperates, in other words is configured to cooperate, with at least one of the first and second tabs 29*a*, 29*b* of the helical spring 22, in the assembled configuration of the spring brake 15, so as to rotate the helical spring 22 around the axis of rotation X in a first direction of rotation.

Such a movement releases the spring brake 15 and, more particularly, the helical spring 22 relative to the drum 23.

The friction force between at least a turn of the helical spring 22 and the inner surface 27 of the housing 26 of the drum 23 is decreased during the rotational driving of the helical spring 22 in the first direction of rotation.

In other words, this movement tends to decrease the diameter of the outer enclosure of the helical spring 22, and therefore to decrease the radial stress between the helical spring 22 and the inner surface 27 of the housing 26 of the drum 23.

Thus, the movement generated by the electric motor 12 can be transmitted from the input member 24 to the output member 25.

The outer enclosure of the helical spring 22 is defined by the outer generatrixes of the turns of the helical spring 22.

The output member 25 has at least a lug 39*a*, 39*b*. The lug 39*a*, 39*b* comprises a recess 40. The recess 40 of lug 39*a*, 39*b* comprises at least a first bearing surface 46 configured to cooperate with one of the first and second tabs 29*a*, 29*b* of the helical spring 22, in the assembled configuration of the spring brake 15.

Advantageously, the output member 25 comprises a first lug 39*a* and a second lug 39*b*, as illustrated in FIGS. 4 and 6 to 8.

Thus, the first and second lugs 39*a*, 39*b* of the output member 25 allow the output member 25 to be made symmetrical with respect to the axis of rotation X, so that the spring brake 15 is balanced, during a rotational movement of the input member 24 relative to the output member 25 around the axis of rotation X.

Advantageously, each of the first and second lugs 39*a*, 39*b* of the output member 25 has a recess 40.

Here, the recess 40 of each of the first and second lugs 39*a*, 39*b* of the output member 25 cooperates, in other words is configured to cooperate, with one of the first and second tabs 29*a*, 29*b* of the helical spring 22, in the assembled configuration of the spring brake 15.

Advantageously, the recess 40 of each of the first and second lugs 39*a*, 39*b* comprises at least a first bearing surface 46 cooperating, in other words being configured to cooperate, with one of the first and second tabs 29*a*, 29*b* of the helical spring 22, in the assembled configuration of the spring brake 15.

Advantageously, the first and second lugs 39*a*, 39*b* of the output member 25 are inserted, in other words configured to be inserted, inside the helical spring 22, in the assembled configuration of the spring brake 15.

The output member 25, in particular one of the first and second lugs 39*a*, 39*b*, cooperates, in other words is configured to cooperate, with at least one of the first and second tabs 29*a*, 29*b* of the helical spring 22, in the assembled configuration of the spring brake 15, so as to rotate the helical spring 22 around the rotation axis X in a second direction of rotation. The second direction of rotation is opposite to the first direction of rotation.

Such a movement activates the spring brake 15, that is to say tends to block or slow the rotation of the helical spring 22 inside the housing 26 of the rotating drum 23.

The friction force between at least one turn of the helical spring 22 and the inner surface 27 of the housing 26 of the drum 23 is increased during the rotational driving of the helical spring 22 in the second direction of rotation.

In other words, this movement tends to increase the diameter of the outer enclosure of the helical spring 22, in particular by bringing the tabs 29*a*, 29*b* of the helical spring 22 closer together, and therefore to increase the radial stress between the helical spring 22 and the inner surface 27 of the housing 26 of the drum 23.

Advantageously, the spring brake 15 comprises a lubricant, not shown, arranged between the helical spring 22 and the friction surface 27 of the drum 23, in particular the inner surface 27 of the housing 26 of the drum 23. The lubricant is, preferably, grease.

Advantageously, the input member 24 is driven, in other words is configured to be driven, in rotation by the electric motor 12, in the assembled configuration of the electromechanical actuator 11.

Figure 8:
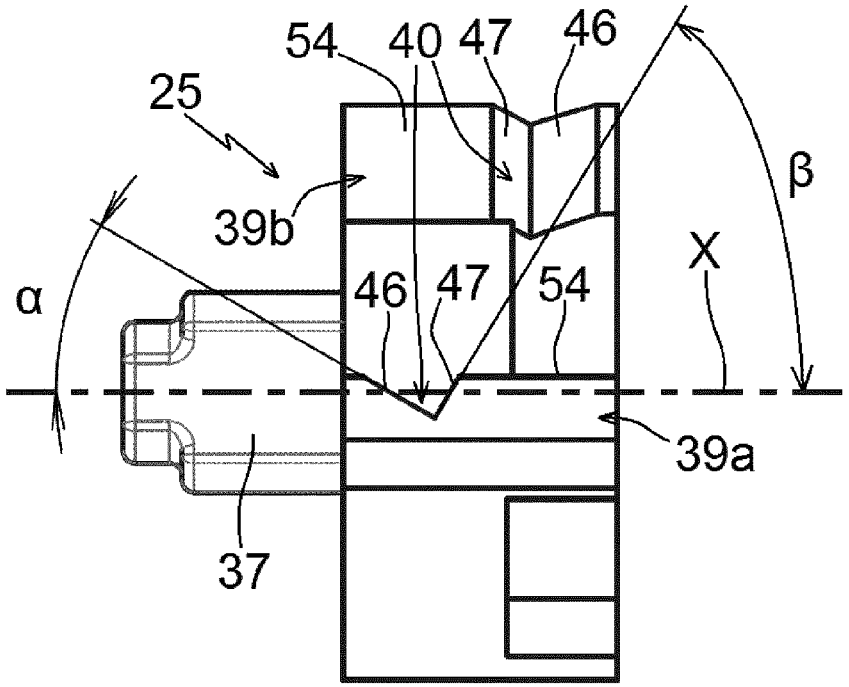
FIG. 8 is a schematic side view of the output member illustrated in FIG. 7.

The first bearing surface 46 of the recess 40, in particular of one of the recesses 40, is inclined relative to the axis of rotation X of the spring brake 15 by an angle of inclination $\alpha$ of non-zero value, as illustrated in FIG. 8.

Thus, the angle of inclination $\alpha$ of the first bearing surface 46 of the recess 40, in particular of one of the recesses 40, of the output member 25 relative to the axis of rotation X of the spring brake 15 prevents the turns of the helical spring 22 from spreading apart from each other, during a braking phase of the spring brake 15 and, more particularly, of a first turn of the helical spring 22 relative to a subsequent turn of the helical spring 22, during a braking phase of the spring brake 15, as well as to reduce the operating noise of the spring brake 15, during the rotational drive of the input member 24 and/or the output member 25 relative to the drum 23, in particular inside the housing 26 of the drum 23.

Here, a wear zone of the first bearing surface 46 of each recess 40 of the output member 25 by one of the first and second tabs 29*a*, 29*b* of the helical spring 22 is centered relative to the first bearing surface 46.

In this way, the angle of inclination α of the first bearing surface 46 of the recess 40, in particular of one of the recesses 40, of the output member 25 in relation to the axis of rotation X of the spring brake 15 allows to guarantee that a lateral force is applied to one of the first and second tabs 29*a*, 29*b* of the helical spring 22, so that the adjacent turns of the helical spring 22 are held contiguous, during a braking phase of the spring brake 15.

In other words, the angle of inclination α of the first bearing surface 46 of one of the recesses 40 of the output member 25 with respect to the axis of rotation X of the spring brake 15 makes it possible to create a bearing of one of the first and second tabs 29*a*, 29*b* of the helical spring 22 on the first bearing surface 46 of one of the recesses 40 of the output member 25, so as to create a partially axial force on the helical spring 22.

The lateral force of the inclined first bearing surface 46 of one of the recesses 40 of the output member 25 on one of the first and second tabs 29*a*, 29*b* of the helical spring 22 can be described as a partial axial force, in the direction of the axis of rotation X of the spring brake 15, since the spring brake 15 has a non-zero axial component.

Moreover, a separation of the turns of the helical spring 22 from each other and, more particularly, of the first turn of the helical spring 22 from the next turn of the helical spring 22, is thus avoided in a state of rest of the spring brake 15, since the turns of the helical spring 22 remain in the same position relative to the drum 23, following a braking phase of the spring brake 15.

Furthermore, the angle of inclination α of the first bearing surface 46 of the recess 40, in particular of one of the recesses 40, of the output member 25 relative to the axis of rotation X of the spring brake 15 makes it possible to induce a force at the level of one of the first and second tabs 29*a*, 29*b* of the helical spring 22 and thus to attenuate the setting in vibration of the helical spring 22, by stabilizing this force at the level of the first turn of the helical spring 22.

The first turn of the helical spring 22 can also be called the end turn of the helical spring 22 connected to one of the first and second tabs 29*a*, 29*b* of the helical spring 22.

Figure 7:
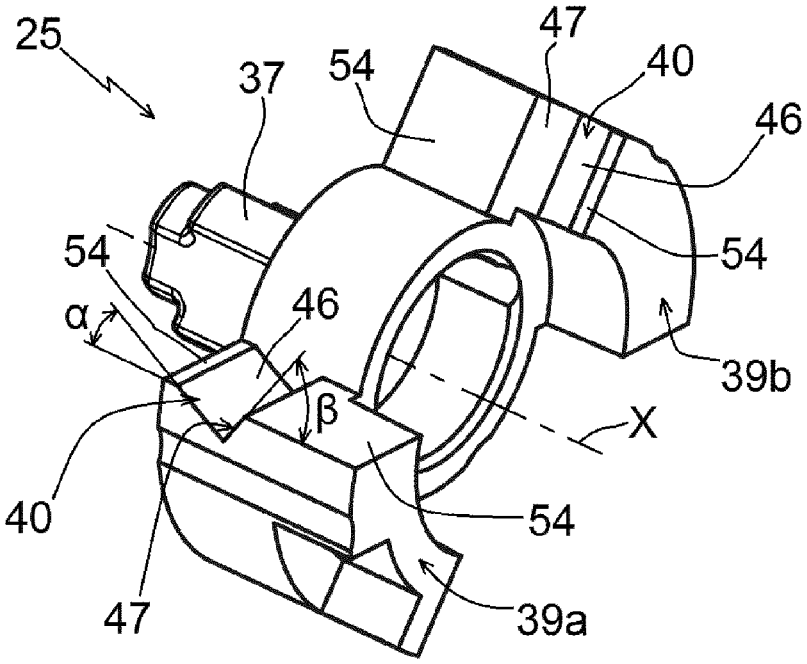
FIG. 7 is a schematic perspective view of an output member of the spring brake illustrated in FIGS. 4 to 6.

In other words, in the assembled configuration of the spring brake 15, the first bearing surface 46 of one of the recesses 40 is inclined with respect to a surface 54 of the first or second lug 39*a*, 39*b* of the output member 25 by the value of the angle of inclination α, as illustrated in FIGS. 7 and 8.

Advantageously, in the assembled configuration of the spring brake 15, the first tab 29*a* of the helical spring 22 cooperates, in other words is configured to cooperate, with a first surface 38*a* of the driving tooth 31 of the input member 24 and the second tab 29*b* of the helical spring 22 cooperates, in other words is configured to cooperate, with a second surface 38*b* of the driving tooth 31 of the input member 24. The second surface 38*b* of the driving tooth 31 is opposite to the first surface 38*a* of the driving tooth 31.

Thus, the driving tooth 31 of the input member 24 is arranged between the first and second tabs 29*a*, 29*b* of the helical spring 22 and cooperates, in other words is configured to cooperate, with either of the tabs 29*a*, 29*b* of the helical spring 22, in the assembled configuration of the spring brake 15 and according to the direction of rotational drive generated by the electric motor 12.

In this way, the driving tooth 31 of the input member 24 has two drive surfaces 38*a*, 38*b*. Each drive surface 38*a*, 38*b* of the driving tooth 31 cooperates, in other words is configured to cooperate, with one of the first and second tabs 29*a*, 29*b* of the helical spring 22, in the assembled configuration of the spring brake 15.

The surface 54 of the first or second lug 39*a*, 39*b* of the output member 25 cooperates, in other words is configured to cooperate, with the first or second drive surface 38*a*, 38*b* of the driving tooth 31.

Here, the surface 54 of the first or second lug 39*a*, 39*b* of the output member 25 is parallel to the axis of rotation X of the spring brake 15. Moreover, the surface 54 of the first or second lug 39*a*, 39*b* of the output member 25 extends on either side of the recess 40.

Advantageously, in the assembled configuration of the spring brake 15, the recess 40 of the output member 25 comprising the first bearing surface 46 inclined relative to the axis of rotation X of the spring brake 15 is that of the first or second lug 39*a*, 39*b* of the output member 25 cooperating, in other words configured to cooperate, with the first or second tab 29*a*, 29*b* of the helical spring 22, during a braking phase of the spring brake 15.

Thus, the tab 29*a*, 29*b* of the helical spring 22 and the first bearing surface 46 of the recess 40 of the output member 25 cooperating, in other words being configured to cooperate, together, in the assembled configuration of spring brake 15, are those intended to activate the spring brake 15, that is to say to generate the friction force between at least a turn of the helical spring 22 and the friction surface 27 of the drum 23, in particular the friction surface 27 of the housing 26 of the drum 23, in other words to rotate the helical spring 22 around the axis of rotation X in the second direction of rotation.

Advantageously, the inclination of the first bearing surface 46 of the recess 40, in particular of one of the recesses 40, relative to the axis of rotation X of the spring brake 15 is such that the first bearing surface 46 is oriented towards the inside of the output member 25.

Thus, the orientation of the first bearing surface 46 inclined from one of the recesses 40 relative to the axis of rotation X of the spring brake 15 allows to guarantee the lateral force on one of the first and second tabs 29*a*, 29*b* of the helical spring 22, so as to maintain the turns of the helical spring 22 contiguous, during a braking phase of the spring brake 15.

Advantageously, the value of the angle of inclination α is in a range of values between 5° and 45° and is, preferably, in the range of 20° to 25°.

Thus, a first limit of the range of values, so-called lower limit with a value of 5°, is determined as the limit below which the angle of inclination α of the first bearing surface 46 of one of the recesses 40 of the output member 25 relative to the axis of rotation X of the spring brake 15 does not allow an axial component of the sufficient lateral force to be exerted on one of the first and second tabs 29*a*, 29*b* of helical spring 22, so that the turns of the helical spring 22 are held contiguous, during a braking phase of spring brake 15.

Moreover, a second limit of the range of values, so-called upper limit of the range of values with a value of 45°, is determined as the limit above which the angle of inclination α of the first bearing surface 46 of one of the recesses 40 of the output member 25 relative to the axis of rotation X of the spring brake 15 induces a lateral force too great on one of the first and second tabs 29*a*, 29*b* of the helical spring 22, which may cause one or more turns of the helical spring 22 to overlap relative to the other turns of the helical spring 22, during a braking phase of spring brake 15.

Advantageously, the first bearing surface 46 of each of the recesses 40 of the output member 25 is inclined relative to the axis of rotation X of the spring brake 15 with an angle of inclination α of non-zero value. Preferably, the value of the angle of inclination α is the same for the first bearing surface 46 of each of the two recesses 40.

Thus, whatever the direction of rotation of the output member 25 with respect to the input member 24 inside the housing 26 of the drum 23, the same effects are obtained, that is to say to avoid a spacing of the turns of the helical spring 22 relative to each other and, more particularly, of a first turn of the helical spring 22 relative to a subsequent turn of the helical spring 22, as well as to reduce the operating noise of the spring brake 15.

In this way, the electromechanical actuator 11 can be mounted at either of the two ends of the winding tube 4, in other words at either a left or right end of the winding tube 4, since the operation of the spring brake 15 is identical in both directions of rotation of the output member 25 with respect to the input member 24 inside the housing 26 of the drum 23.

Advantageously, the recess 40 comprises at least a second bearing surface 47, inclined relative to the axis of rotation X of the spring brake 15 by an angle of inclination β of non-zero value.

We note the angle of inclination β of the second bearing surface 47 relative to the axis of rotation X. This angle β has a non-zero value, which can be, for example, in a range of values between 40° and 100°.

Advantageously, the recess 40 of each of the first and second lugs 39*a*, 39*b* also comprises a second bearing surface 47 and, optionally, a third bearing surface, not shown, configured to cooperate with one of the first and second tabs 29*a*, 29*b* of the helical spring 22, in the assembled configuration of the spring brake 15.

Here, the second bearing surface 47 is inclined, relative to the axis of rotation X, in the opposite direction to the first bearing surface 46.

Thus, the first and second bearing surfaces 46, 47 give the recess 40 the shape of a receding dihedral which extends from the surface 54 of the first or second lug 39*a*, 39*b*.

In this way, the second bearing surface 47 and, optionally, the third bearing surface of the recess 40 of each of the first and second lugs 39*a*, 39*b* provide a respective stop, so that the first or second tabs 29*a*, 29*b* of the helical spring 22 is held in position inside the recess 40.

Here and as illustrated in FIGS. 4 and 6 to 8, the recess 40 of the first lug 39*a* of the output member 25 cooperates, in other words is configured to cooperate, with the first tab 29*a* of the helical spring 22, in the assembled configuration of the spring brake 15. Moreover, the recess 40 of the second lug 39*b* of the output member 25 cooperates, in other words is configured to cooperate, with the second tab 29*b* of the helical spring 22, in the assembled configuration of the spring brake 15.

Here, and as illustrated in FIGS. 4 and 5, the output member 25 is centered relative to the input member 24 by means of a first shaft 49. The first shaft 49, which is shown in cross section and hatched in FIG. 5, is inserted, on one hand, in a bore 50 of the output member 25 and, on the other hand, in a bore 51 of the input member 24, in the assembled configuration of the spring brake 15.

Thus, a second shaft 37, in particular of the output member 25, makes it possible to receive and transmit torque from the electric motor 12.

In this embodiment, the second shaft 37 of the output member 25, cooperates, in other words is configured to cooperate, with the reducer 14, in the assembled configuration of the spring brake 15. More particularly, the second shaft 37 is inserted in a housing, not shown, of the reducer 14, in the assembled configuration of the spring brake 15.

Thus, the second shaft 37 allows to receive and transmit torque coming from the electric motor 12 to the reducer 14, via the first shaft 49.

Here, the first shaft 49 and the second shaft 37 are respectively centered relative to the axis of rotation X, in the assembled configuration of the electromechanical actuator 11.

Advantageously, the cap 33 comprises an opening 53. Moreover, the opening 53 of the cap 33 is through-going. The opening 53 of the cap 33 cooperates, in other words is configured to cooperate, with the second shaft 37, in particular the output member 25, in the assembled configuration of the spring brake 15.

Thus, the second shaft 37 is inserted into the opening 53 of the cap 33, so that it extends on both sides of the cap 33, in the assembled configuration of the spring brake 15.

Preferably, the input member 24 comprises a first plate 30. Moreover, the cap 33 comprises a second plate 32.

Advantageously, in the assembled configuration of the spring brake 15, the first tab 29*a* of the helical spring 22 extends along the first plate 30 of the input member 24 and the second tab 29*b* of the helical spring 22 extends along the second plate 32 of the cap 33.

Here, the first plate 30 is integral with the driving tooth 31, preferably integral with it.

Here, and as illustrated in FIGS. 4 and 5, the helical spring 22 and the output element 25 are held in position axially between the first plate 30 of the input member 24 and the second plate 32 of the cap 33.

The input member 24 and, more particularly, the first plate 30 comprises a spacer 34. The spacer 34 extends between the input member 24 and the cap 33, in the assembled configuration of the spring brake 15.

Thus, the spacer 34 of the input member 24 allows to maintain an axial distance between the input member 24 and the cap 33 and, more particularly, between the first and second plates 30, 32.

Here, the spacer 34 of the input member 24 is arranged diametrically opposite to the driving tooth 31 of the input member 24, as illustrated in FIGS. 4 and 5.

Moreover, in this example of an embodiment, the driving tooth 31 of the input member 24 corresponds to another spacer.

Thus, the driving tooth 31 of the input member 24 also allows to maintain the axial spacing between the input member 24 and the cap 33 and, more particularly, between the first and second plates 30, 32.

Alternatively, not shown, the cap 33 and, more particularly, the second plate 32 comprises the spacer 34. The spacer 34 then also extends between the input member 24 and the cap 33, in the assembled configuration of the spring brake 15.

In such a case, the spacer 34 of the cap 33 can be arranged diametrically opposite to the driving tooth 31 of the input member 24, relative to the axis of rotation X, in the assembled configuration of the spring brake 15.

Here, the driving tooth 31 and the spacer 34 make it possible to create the spring brake 15, in particular the input member 24, symmetrically relative to the axis of rotation X, so that the spring brake 15 is balanced, when the input member 24 rotates about the axis of rotation X relative to the output member 25.

Here and as illustrated in FIGS. 4 to 6, the first and second plates 30, 32 each comprise a peripheral flange 35, 36. The two peripheral flanges 35, 36 are arranged opposite to each other along the axis of rotation X, in the assembled configuration of the spring brake 15.

Advantageously, in the assembled configuration of the spring brake 15, the first tab 29*a* of the helical spring 22 is arranged between the first surface 38*a* of the driving tooth 31 of the input member 24 and the spacer 34. Moreover, the second tab 29*b* of the helical spring 22 is arranged between the second surface 38*b* of the driving tooth 31 of the input member 24 and the spacer 34.

Advantageously, the input member 24 and the cap 33 and, more particularly, the first and second plates 30, 32 are held together rotationally fixed around the axis of rotation X, in the assembled configuration of the spring brake 15.

Here, the input member 24 and the cap 33 are attached to each other by means of fastening elements 52*a*, 52*b*.

Advantageously, the fastening elements 52*a*, 52*b* of the input member 24 and the cap 33 are pluggable fastening elements and, in particular, studs 52*a* at the driving tooth 31 and spacer 34 and holes 52*b* in the cap 33, as it happens in the second plate 32.

In this exemplary embodiment, a first fastening element 52*a* of the input member 24 is provided at the driving tooth 31 of the input member 24. Moreover, a second fastening element 52*a* of the input member 24 is provided at the spacer 34 of the input member 24.

Here, the input member 24 has two fastening elements 52*a* and the cap 33 has two fastening elements 52*b*.

The number of fasteners for the input member and the cap is not limiting and can be different, in particular greater than or equal to three.

Alternatively, not shown, the input member 24 and the cap 33 and, more particularly, the first and second plates 30, 32 can be held together fixed by means of elastic snap-on fastening elements.

The output element 25 is configured to be connected to the screen 2 of the concealing device 3.

Advantageously, the input member 24 and the output member 25 are made of plastic material.

Moreover, the cap 33 is made of plastic material.

As a non-limiting example, the plastic material of the input member 24, the output member 25 and the cap 33 can be made of poly-butylene terephthalate, also known as PBT, or poly-acetal, also known as POM.

Alternatively, the outlet member 25 can be made of zamac (an acronym for the names of the metals it is made of: zinc, aluminum, magnesium and copper).

Preferably, the drum 23 is made of steel, especially sintered steel.

Thus, the use of sintered steel to make the drum 23 reduces the friction resistance of the helical spring 22 against the internal friction surface 27 of the housing 26 of the drum 23.

Figure 9:
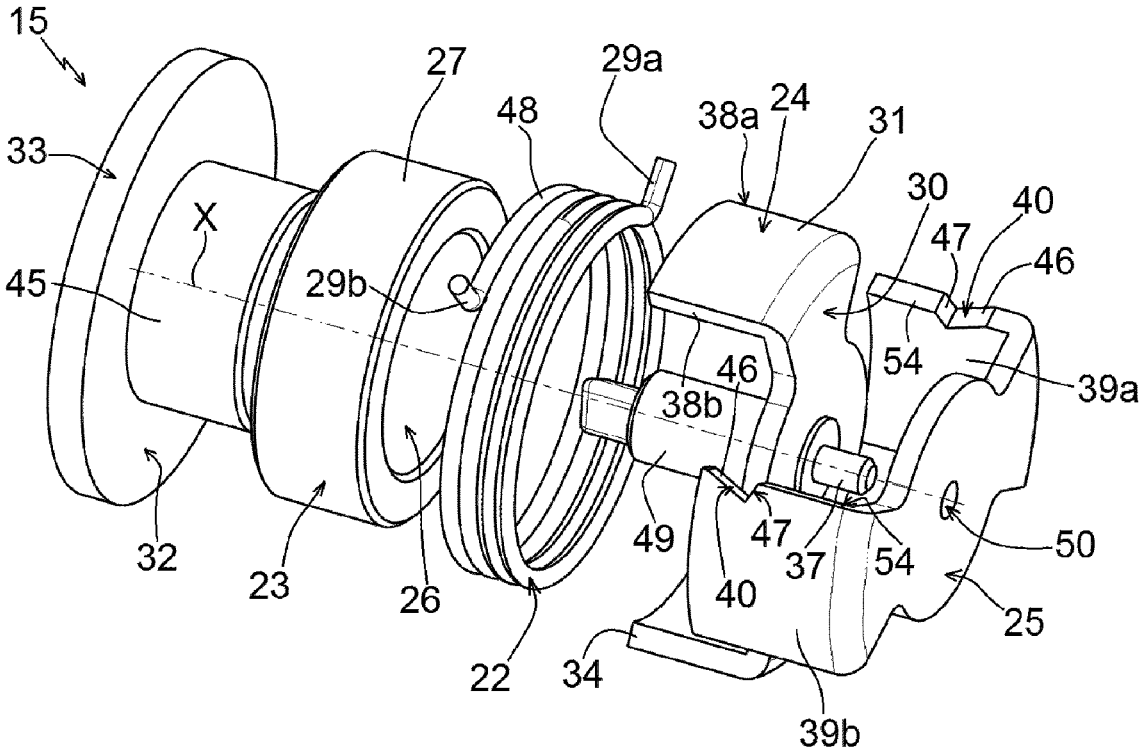
FIG. 9 is a view similar to FIG. 4 illustrating a spring brake of an electromechanical actuator according to a second embodiment, where the drum of the spring brake is shown.
Figure 10:
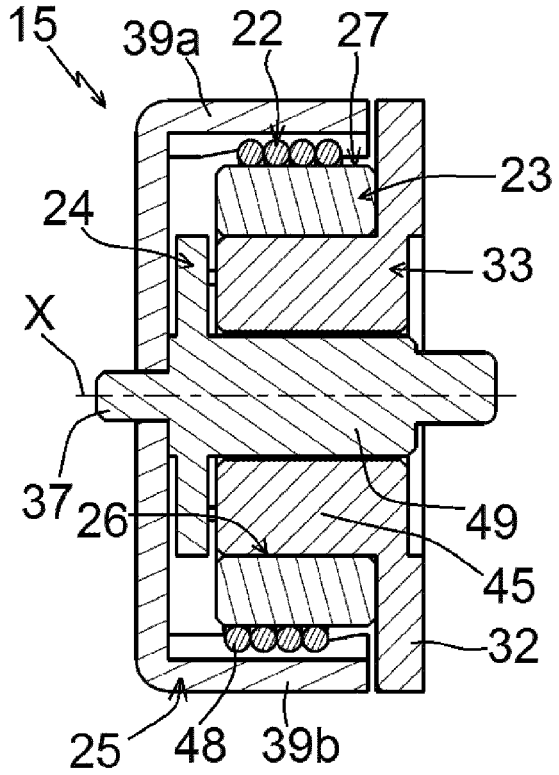
FIG. 10 is a view similar to FIG. 5 illustrating the spring brake of the electromechanical actuator according to the second embodiment.
Figure 11:
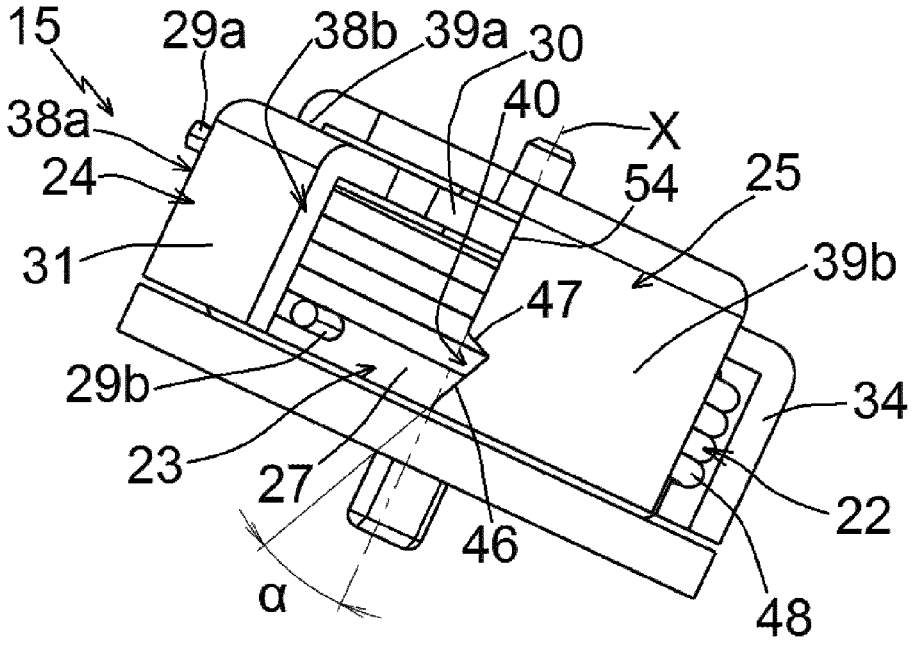
FIG. 11 is a schematic elevation view of the spring brake of the electromechanical actuator according to the second embodiment, in an assembled configuration of the spring brake.

In a second embodiment, shown in FIGS. 9 to 11, the elements similar to those of the first embodiment have the same references and function as explained above. In the following, we describe, mainly, what distinguishes this second embodiment from the previous one. In the following, when a reference sign is used without being reproduced on one of the FIGS. 9 to 11, it corresponds to the object bearing the same reference on one of the FIGS. 1 to 8.

We now describe, with reference to FIGS. 9 to 11, the spring brake 15 of the electromechanical actuator 11 according to the second embodiment of the invention.

The left and right sides of FIG. 9 are reversed with respect to the left and right sides of FIG. 10.

Advantageously, the helical spring 22, the input member 24 and the output member 25 are arranged around the drum 23, in an assembled configuration of the spring brake 15.

Here, the friction surface 27 of the drum 23 is an outer surface of the drum 23. The outer surface 27 of the drum 23, called the friction surface, cooperates, in other words is configured to cooperate, with at least a turn of the helical spring 22, in the assembled configuration of the spring brake 15.

Thus, at least a turn of the helical spring 22 is radially stressed by the drum 23.

In this case, the helical spring 22 is mounted tightly around the drum 23, so that the helical spring 22 and the drum 23 are frictionally connected, when the helical spring 22 is at rest, as illustrated in FIG. 10.

Advantageously, each of the first and second tabs 29*a*, 29*b* of helical spring 22 extends radially relative to the axis of rotation X and, in particular, towards the outside of the helical spring 22.

Advantageously, the driving tooth 31 of the input member 24 is arranged outside the helical spring 22, in the assembled configuration of the spring brake 15.

The frictional force between at least a turn of the helical spring 22 and the outer surface 27 of the drum 23 is reduced when the helical spring 22 is rotated in the first direction of rotation.

Here, this movement tends to increase the diameter of the inner enclosure of the helical spring 22 and thus to decrease the radial stress between the helical spring 22 and the outer surface 27 of the drum 23.

The frictional stress between at least a turn of the helical spring 22 and the outer surface 27 of the housing 26 of the drum 23 is increased when the helical spring 22 is rotated in the second direction of rotation.

Here, this movement tends to decrease the diameter of the inner enclosure of the helical spring 22, in particular by bringing together the first and second tabs 29*a*, 29*b* of the helical spring 22, and thus to increase the radial stress between the helical spring 22 and the outer surface 27 of the housing 26 of the drum 23.

In this second embodiment, the lugs 39*a*, 39*b* and, more particularly, the first and second lugs 39*a*, 39*b* of the output member 25 are arranged, in other words configured to be arranged, outside the helical spring 22, in the assembled configuration of the spring brake 15.

Here, the housing 26 of the drum 23 is assembled, in other words configured to be assembled, around a shaft 45 of the cap 33, in the assembled configuration of spring brake 15.

Thus, the shaft 45 of the cap 33 allows the drum 23 to be supported, in the assembled configuration of the spring brake 15.

Here, the first shaft 49, on one hand, is inserted into the bore 50 of the output member 25 in the assembled configuration of the spring brake 15 and, on the other hand, is an integral part of the input member 24, so that the first shaft 49 and the input member 24 are one piece.

Moreover, the second shaft 37 is an integral part of the first shaft 49, so that the second shaft 37 and the first shaft 49 are one piece.

Here, the connection between the input member 24 and the output member 25 is implemented by means of a housing 50 of the output member 25 cooperating, in other words being configured to cooperate, with the second shaft 37 of the input member 24, in the assembled configuration of the spring brake 15.

In this example of an embodiment, the housing 50 of the output member 25 is realized by means of a bore, positioned at the center of the output member 25 and, more particularly, centered relative to the axis of rotation X, in the assembled configuration of the spring brake 15. Moreover, the second shaft 37 of the input member 24 is realized in the form of a pin, arranged in alignment with the first shaft 49. The pin 37 of the input member 24 is therefore also centered relative to the rotation axis X, in the assembled configuration of the spring brake 15.

Thus, the pin 37 of the input member 24 is inserted into the housing 50 of the output member 25.

In this way, the output member 25 is centered relative to the input member 24, using the housing 50 of the output member 25 and the pin 37 of the input member 24.

Here, the helical spring 22 and the input member 24 are held in position axially between the output member 25 and the second plate 32 of the cap 33.

As in the first embodiment, a dihedral-shaped recess 40 is delimited by two bearing surfaces 46, 47 inclined relative to the axis of rotation X of the spring brake 15 on each of the lugs 39*a*, 39*b*. The recesses 40 receive the first and second tabs 29*a*, 29*b* of the helical spring 22, in the assembled configuration of the spring brake 15.

Thanks to the present invention, whatever the embodiment, the angle of inclination of the first bearing surface of the recess of the output member relative to the axis of rotation of the spring brake makes it possible to avoid a spacing of the turns of the helical spring relative to each other, during a braking phase of the spring brake, and, more particularly, of a first turn of the helical spring relative to a following turn of the helical spring, during a braking phase of the spring brake, as well as to reduce the operating noise of the spring brake, during the rotational drive of the input and/or output member relative to the drum.

In this way, the angle of inclination of the first bearing surface of the recess of the output member relative to the axis of rotation of the spring brake allows to guarantee a lateral force on one of the first and second lugs of the helical spring, so that the turns of the helical spring are held contiguous, during a braking phase of the spring brake.

Moreover, a detachment of the turns of the helical spring from each other and, more particularly, of the first turn of the helical spring relative to the next turn of the helical spring is avoided in a state of rest of the spring brake, since the turns of the helical spring remain in the same position relative to the drum, following a braking phase of the spring brake.

Many changes can be made to the example of an embodiment previously described without going beyond the scope of the invention defined by the claims.

In a variant, not shown, the electronic control unit 44 is positioned outside the casing 13 of the electromechanical actuator 11 and, in particular, mounted on the frame 20 or in the torque support 19.

Alternatively, not shown, the connection between the input member 24 and the output member 25 is not implemented by means of the first shaft 49 but by means of a housing of the input member 24, cooperating, in other words being configured to cooperate, with a second shaft 37 of the output member 25, in the assembled configuration of the spring brake 15. In this variant, the housing of the input member 24 is made by means of a bore, arranged in the center of the input member 24 and, more particularly, centered with respect to the axis of rotation X, in the assembled configuration of the spring brake 15. Moreover, the output member 25 comprises a pin, arranged in alignment with the shaft 37. The pin of the output member 25 is therefore also centered with respect to the axis of rotation X, in the assembled configuration of the spring brake 15. Thus, the pin of the output member 25 is inserted into the housing of the input member 24. In this way, the output member 25 is centered with respect to the input member 24, by means of the housing of the input member 24 and the pin of the output member 25.

Moreover, the considered embodiments and alternatives may be combined to generate new embodiments of the invention, without going beyond the scope of the invention defined by the claims.

The invention claimed is:

1. An electromechanical actuator for a home automation installation for closure or sun-protection,
- the electromechanical actuator comprising at least:
  - an electric motor,
  - a reducer, and
  - a spring brake having an axis of rotation,
- the spring brake comprising at least:
  - a helical spring,
    - the helical spring being formed from a wire,
    - a first end of the helical spring forming a first tab,
    - a second end of the helical spring forming a second tab,
    - the helical spring having contiguous coils, in a state of rest of the spring brake,
  - a drum,
    - the drum comprising a friction surface, the friction surface cooperating with at least one coil of the helical spring, in an assembled configuration of the spring brake,
  - an input member, and
  - an output member,
    - the output member comprising at least one lug,
    - the at least one lug comprising a recess,
    - the recess in the at least one lug comprising at least one first bearing surface, the at least one first bearing surface cooperating with one of the first and second tabs of the helical spring, in the assembled configuration of the spring brake,
  - wherein the at least one first bearing surface of the recess in the at least one lug of the output member is inclined, in a longitudinal direction of the axis of rotation of the spring brake, and relative to the axis of rotation of the spring brake by an angle of inclination of non-zero value.

2. The electromechanical actuator for a home automation installation for closure or sun-protection according to claim 1, wherein the value of the angle of inclination is in a range of values between 5' and 45°.

3. The electromechanical actuator for a home automation installation for closure or sun-protection according to claim 2, wherein the angle of inclination of the at least one first bearing surface of the recess in the at least one lug with respect to the axis of rotation of the spring brake is such that the at least one first bearing surface is directed towards the inside of the output member.

4. The electromechanical actuator for a home automation installation for closure or sun-protection according to claim 2, wherein:
- the at least one lug of the output member comprises a first lug and a second lug,
- each of the first and second lugs comprises the recess, the recess of each of the first and second lugs comprises the at least one first bearing surface configured to cooperate with one of the first and second tabs of the helical spring, in the assembled configuration of the spring brake, and the at least one first bearing surface of at least one of the recesses of the first a nd second lugs of the output member is inclined, in the longitudinal direction of the axis of rotation of the spring brake, and relative to the axis of rotation of the spring brake by the angle of inclination of non-zero value.

5. The electromechanical actuator for a home automation installation for closure or sun-protection according to claim 2, wherein each tab of the helical spring extends radially relative to the axis of rotation of the spring brake.

6. The electromechanical actuator for a home automation installation for closure or sun-protection according to claim 2, wherein the value of the angle of inclination is in a range of values between 20° and 25°.

7. The electromechanical actuator for a home automation installation for closure or sun-protection according to claim 1, wherein the angle of inclination of the at least one first bearing surface of the recess in the at least one lug with respect to the axis of rotation of the spring brake is such that the at least one first bearing surface is directed towards the inside of the output member.

8. The electromechanical actuator for a home automation installation for closure or sun-protection according to claim 7, wherein:

the at least one lug of the output member comprises a first lug and a second lug, each of the first and second lugs comprises the recess, the recess of each of the first and second lugs comprises the at least one first bearing surface configured to cooperate with one of the first and second tabs of the helical spring, in the assembled configuration of the spring brake, and the at least one first bearing surface of at least one of the recesses of the first and second lugs of the output member is inclined, in the longitudinal direction of the axis of rotation of the spring brake, and relative to the axis of rotation of the spring brake by the angle of inclination of non-zero value.

9. The electromechanical actuator for a home automation installation for closure or sun-protection according to claim 7, wherein each tab of the helical spring extends radially relative to the axis of rotation of the spring brake.

10. The electromechanical actuator for a home automation installation for closure or sun-protection according to claim 4, wherein each tab of the helical spring extends radially relative to the axis of rotation of the spring brake.

11. The electromechanical actuator fora home automation installation for closure or sun-protection according to claim 1, wherein:

the at least one lug of the output member comprises a first lug and a second lug, each of the first and second lugs comprises the recess, the recess of each of the first and second lugs comprises the at least one first bearing surface configured to cooperate with one of the first and second tabs of the helical spring, in the assembled configuration of the spring brake, and the at least one first bearing surface of at least one of the recesses of the first and second lugs of the output member is inclined, in the longitudinal direction of the axis of rotation of the spring brake, and relative to the axis of rotation of the spring brake by the angle of inclination of non-zero value.

12. The electromechanical actuator fora home automation installation for closure or sun-protection according to claim 11, wherein the at least one first bearing surface of each of the recesses of the first and second lugs of the output member is inclined, in the longitudinal direction of the axis of rotation of the spring brake, and relative to the axis of rotation of the spring brake by the angle of inclination of non-zero value.

13. The electromechanical actuator for a home automation installation for closure or sun-protection according to claim 11, wherein each tab of the helical spring extends radially relative to the axis of rotation of the spring brake.

14. The electromechanical actuator for a home automation installation for closure or sun-protection according to claim 12, wherein each tab of the helical spring extends radially relative to the axis of rotation of the spring brake.

15. The electromechanical actuator for a home automation installation for closure or sun-protection according to claim 1, wherein each tab of the helical spring extends radially relative to the axis of rotation of the spring brake.

16. The electromechanical actuator for a home automation installation for closure or sun-protection according to claim 1, wherein:

the input member comprises a driving tooth, in the assembled configuration of the spring brake, the first tab of the helical spring cooperates with a first surface of the driving tooth of the input member, and the second tab of the helical spring cooperates with a second surface of the driving tooth of the input member, the second surface of the driving tooth being opposite to the at least one first surface of the driving tooth.

17. The electromechanical actuator for a home automation installation for closure or sun-protection according to claim 1, wherein the spring brake also comprises a cap.

18. The electromechanical actuator for a home automation installation for closure or sun-protection according to claim 1, wherein the recess in the at least one lug comprises at least one second bearing surface inclined, in the longitudinal direction of the axis of rotation of the spring brake, and relative to the axis of rotation of the spring brake by an angle of inclination of non-zero value.

19. A home automation installation for closure or sun-protection comprising a screen that can be wound on a winding tube driven in rotation by an electromechanical actuator according to claim 1.

20. The electromechanical actuator for a home automation installation for closure or sun-protection according to claim 4, wherein the at least one first bearing surface of each recesses of the first and second lugs of the output member is inclined, in a longitudinal direction of the axis of rotation of the spring brake, and relative to the axis of rotation of the spring brake by the angle of inclination of non-zero value.

* * * * *